US005945953A

United States Patent [19]

Tsuda et al.

[11] Patent Number: 5,945,953

[45] Date of Patent: Aug. 31, 1999

[54] RETRACTABLE ANTENNA ASSEMBLY FOR A PORTABLE RADIO APPARATUS

[75] Inventors: Shinichiro Tsuda; Ichiro Toriyama, both of San Diego, Calif.

[73] Assignees: Sony Corporation, Tokyo, Japan; Sony Electronics, Inc., Park Ridge, N.J.

[21] Appl. No.: 08/841,561

[22] Filed: Apr. 30, 1997

[51] Int. Cl.[6] ..... H01Q 1/24

[52] U.S. Cl. ..... 343/702; 343/895; 343/900

[58] Field of Search ..... 343/702, 715, 343/749, 895, 900, 901, 903; H01Q 1/24, 1/36

[56] References Cited

U.S. PATENT DOCUMENTS

| | | | |
|---|---|---|---|
| 5,764,191 | 6/1998 | Tsuda | 343/792 |
| 5,861,859 | 1/1999 | Kanayama et al. | 343/895 |

FOREIGN PATENT DOCUMENTS

| | | |
|---|---|---|
| 0 716 469 A1 | 6/1996 | European Pat. Off. . |
| 0 755 091 A1 | 1/1997 | European Pat. Off. . |

*Primary Examiner*—Frank G. Font
*Assistant Examiner*—Layla Lauchman
*Attorney, Agent, or Firm*—Frommer Lawrence & Haug, LLP.; William S. Frommer

[57] ABSTRACT

An antenna assembly for a portable radio apparatus, such as a cellular phone, having a housing with a signal line therein includes a helical antenna extending from the housing and having first and second helical portions which are electrically separated from each other and a rod antenna movable relative to the helical antenna between a retracted position, in which the rod antenna is removed from within the helical antenna into the interior of the housing, and an extended position, in which the rod antenna extends through the helical antenna to the exterior of the housing. One of the first and second helical portions of the helical antenna is electrically connected with the signal line within the housing so that when the rod antenna in its retracted position, the one helical portion connected with the signal line operates as a radiator, and an electrical connector is moveable with the rod antenna for electrically connecting the first and second helical portions with each other when the rod antenna is in its extended positions so that the first and second helical portions then operate jointly as a radiator and also match with the rod antenna which is electromagnetically coupled with the signal line through the helical antenna so as to act principally as a radiator.

22 Claims, 7 Drawing Sheets

RETRACTABLE ANTENNA ASSEMBLY FOR A PORTABLE RADIO APPARATUS

BACKGROUND OF THE INVENTION

1. Field of the Invention

This invention relates to an antenna assembly, and more particularly to a retractable antenna assembly suitable for use in a compact portable radio apparatus, such as, a cellular phone.

2. Description of the Prior Art

In recent years, portable radio apparatuses have been reduced in size and weight. Accordingly, antenna assemblies used for such portable radio apparatuses are also required to be smaller. As an antenna assembly which more or less satisfies the above requirement, many manufacturers are developing whip antennas which can be retracted into the housing when the apparatus is not used for communications. The whip antenna is pulled out of the housing to be extending therefrom when the apparatus is used for communications. Portable radio apparatuses in an early stage have utilized this type of whip antenna which is relatively simple.

Such a simple whip antenna, when extending from the housing body, is operative as a monopole antenna. However, when the antenna is in a retracted position within the housing, it cannot obtain a sufficient gain because the antenna retracted into the housing is placed near the ground where it causes an input impedance to increase, whereby impedance matching cannot be readily established.

In order to improve the gain of the antenna when retracted into the housing, a whip antenna of a so-called top loading type came into use instead of the simple whip antenna described above. The top loading type whip antenna comprises a helical antenna electrically connected to the top or free end of a rod antenna. When this type of whip antenna extends from the housing for use, radio waves can be radiated from both the helical antenna and the rod antenna. When the antenna is retracted into the housing, radio waves can still be radiated from the helical antenna.

However, in this type of whip antenna, the rod antenna does not contribute to the radiation of radio waves when it is retracted, but rather operates as an open stub which affects the input impedance of the antenna. Such open stub particularly causes disturbance of impedance matching to an extent depending upon the distance between the retracted rod antenna and circuit boards in the housing. Further, if a shield in the housing is not complete, signals are undesirably input through the rod antenna in a retracted position and such signals can penetrate to the inside of the shield.

Because of these problems associated with the whip antenna, another type of antenna assembly has been developed which includes a rod antenna and a helical antenna, but in which the rod antenna, when retracted into the housing, is electrically isolated from the helical antenna. An example of such a retractable antenna assembly will be described with reference to FIGS. 1A and 1B which show a conventional retractable antenna assembly 100 in an extended position and in a retracted position, respectively.

More particularly, the retractable antenna assembly 100 is shown to generally comprise a fixed antenna part 101, constituted by a one-piece helical antenna 102 housed within a cylindrical antenna cover 103, and a movable antenna part 104 constituted by a rod antenna 105 enveloped in a cover 106.

The fixed antenna part 101 further includes a metal end piece 107 in the form of a disk with an externally threaded hub 108 extending downwardly from the disk 107 about an axial bore 109. An annular metal plate 110 at the lower end of the helical antenna 102 electrically connects the latter to the disk or end piece 107 and the lower end of the antenna cover 103 is suitably secured on the periphery of disk 107 for positioning the cover 103 in enveloping relation to the helical antenna 102. The cover 103 has an upper end wall 111 above the upper end of the helical antenna 102 with a central bore 112 extending through end wall 111 in axial alignment with the bore 109 in hub 108. Such bores 109 and 112 are dimensioned so that the movable antenna part 104, that is, the rod antenna 105 and the associated cover 106, can move slidably through bores 109 and 112 between the extended and retracted positions of FIGS. 1A and 1B, respectively.

A knob 113 is formed on, or otherwise secured to, the upper end of cover 106 and may be grasped by the user for effecting movements of the movable antenna part 104 between its extended and retracted positions. The knob 113 is also effective to prevent inadvertent downward separation of the movable antenna part 104 from the fixed antenna part 101. An annular protrusion 114 is formed on antenna cover 106 immediately below knob 113 and is dimensioned for snap-in engagement in a similarly shaped indentation or detent formed in the bore 112 extending through end wall 111 of the cover 103. The engagement of the protrusion 114 in the detent or indentation in bore 112, as in FIG. 1B, is effective to releasably retain the movable antenna part 104 in its retracted position.

A stopper 115 is provided on the lower end portion of the cover 106 and is formed with an annular protrusion 116 which, upon movement of the movable antenna part 104 to the extended position shown in FIG. 1A engages, in a snap-in manner, in a similarly shaped indentation or detent 117 formed in the surface of bore 109. Such engagement of protrusion 116 within indentation 117 is effective to releasably retain the movable antenna part 104 in its extended position. In the illustrated antenna assembly 100 according to the prior art, the stopper 115 at the lower end of the movable antenna part 104 is of an electrical insulating material, for example, of the same material as the cover 106, so that an electrical connection to the rod antenna 105 cannot be established through the stopper 115.

In order to provide for the mounting of the retractable antenna assembly 100 on a cellular phone or other portable radio apparatus 120, the housing 121 of such apparatus is conventionally molded of a suitable plastic with an opening in which a conductive metal mounting member 122 is embedded. Such mounting member 122 has a boss with an internally threaded bore 123 in which the externally threaded hub 108 can be threadably engaged. When the antenna assembly 100 is thus mounted on housing 121, the helical antenna 102 is continuously powered from a power supply circuit 124 through an antenna clip 125 which establishes an electrical connection between a signal line extending from the power supply circuit 124 and the metal mounting member 122 which is, in turn, electrically contacted with the hub 108 of the disk 107, and through the annular metal plate 110 in electrical connection with the helical antenna .102.

When the movable antenna part 104 of antenna assembly 100 is in its extended position shown on FIG. 1A, rod antenna 105 extends through helical antenna 102. By reason of the foregoing, even though, in the extended position, stopper 115 of an insulating material insures that there will be no electrical connection between helical antenna 102 and rod antenna 105, the rod antenna 105 is powered by electromagnetic coupling between helical antenna 102 and rod antenna 105 extending axially therethrough. As a result, in the extended position, rod antenna 105 mainly operates as a monopole antenna which has its ground level at the ground of the shielding case conventionally provided within the housing 121 of the mobile or portable radio apparatus 120 and the ground of the circuit board 126 therein. Although the helical antenna 102, being continuously powered, is powered along with the rod antenna 105 when the latter is in its extended position, the helical antenna 102 is then merely operable as an accessory of the rod antenna 105.

On the other hand, when the movable antenna part 104 of assembly 100 is in its retracted position shown on FIG. 1B, there is no electrical connection to the rod antenna 104 and there is a substantial axial spacing between the upper end of rod antenna 105 and the lower end of the helical antenna 102 and the metal members 107, 110 and 122 connected thereto. As a result of the foregoing, electromagnetic coupling between the helical antenna 102 and the rod antenna 105 is avoided when the movable antenna part 104 is in its retracted position. Therefore, rod antenna 105, when in its retracted position, has no affect on the performance of helical antenna 102 which then operates as a single helical antenna having its ground level at the ground of the shielding case inside housing 121 and the ground of the circuit board 126.

In a modification of the antenna assembly according to the prior art which includes a rod antenna 105 and a helical antenna 102, and in which the rod antenna, when retracted into the housing, is electrically isolated from the helical antenna, the stopper 115 of insulating material at the lower end of the movable antenna part 104 is replaced by an electrically conductive metal stopper which is electrically connected with the rod antenna 105 within the cover 106. In such modified example of the prior art, when the movable antenna part is in its extended position, for example, as in FIG. 1A, an electrical circuit for powering the rod antenna 105 is established from power supply circuit 124, through antenna clip 125, mounting member 122, hub 108 of disc 107 and the noted metal stopper that replaces insulating stopper 115, directly to the lower end of rod antenna 105. In this case also, when the antenna assembly is in its extended position, both the helical antenna 102 and the rod antenna 105 are powered and the rod antenna mainly operates as a monopole antenna which has its ground level at the ground of the shielding case conventionally provided within the housing 121 and the ground of the circuit board 126 therein, while the helical antenna 102, being continuously powered once again, is merely operable as an accessory of the rod antenna 105 in the extended position of the latter.

In the retractable antenna assembly according to the prior art which has been described above with reference to FIGS. 1A and 1B, the helical antenna 102 enables the associated portable or mobile radio apparatus, such as, a cellular 'phone, to receive an incoming call even in the retracted position of the rod antenna 105, whereas, with the rod antenna in its extended position, the performance of the antenna assembly is improved for actual communication.

In retractable antenna assemblies of the type described above with reference to FIGS. 1A and 1B, antenna lengths in the extended and retracted positions are designed on the basis of a wavelength of the required frequency band, for example, 1.9 GHz. More specifically, the length of the helical antenna is determined so as to satisfy the required antenna length with the movable antenna part 104 in its retracted position, while the length of the rod antenna 105 is determined to satisfy the required antenna length with the movable antenna part 104 in its extended position. It had been supposed that designing the rod antenna and the helical antenna of the known antenna assembly 100 in the described manner would achieve the optimum antenna performance in the required frequency band. However, at a frequency as high as 1.9 GHz, electromagnetic coupling between the rod or monopole antenna and the helical antenna, which occurs in the extended position of the movable antenna part 104, is likely to produce undesirable resonance. In some cases, such undesirable resonance may be produced around a frequency close to the required frequency band so that the performance of the monopole antenna is degraded thereby.

The undesirable resonance may be moved away from the required frequency band by modifying the parameters of the helical antenna 102, such as, the length, pitch and number of turns thereof. However, such modification of the helical antenna parameters in order to avoid undesirable resonance necessarily changes the helical antenna condition which has been optimized for obtaining the best performance of the antenna assembly 100 in the retracted position of its movable part 104. On the other hand, without such modification of the helical antenna parameters, the resulting undesirable resonance would degrade the performance of the antenna assembly 100 with its movable antenna part 104 in the extended position. In other words, optimizing the performance of the helical antenna 102 with the movable antenna part 104 in its retracted position sometimes conflicts with the avoidance of undesirable resonance in the extended position of antenna part 104.

In an attempt to avoid the foregoing problems, it has been proposed, for example, as disclosed in detail in U.S. patent application Ser. No. 08/729,705, filed Oct. 7, 1996, by Shinichiro Tsuda (one of the inventors named herein) and having a common assignee herewith, to provide an antenna assembly similar to that described above with reference to FIGS. 1A and 1B, but in which the helical antenna includes first and second helical portions which are electrically separated from each other, with one of such helical portions being continuously connected to a power supply, and with the helical portions of the helical antenna being electrically connected with each other, as by a connector mounted on the cover of the rod antenna, only when the rod antenna is in its retracted position at which time the first and second helical portions operate as a single helical antenna.

However, it has been determined that, with an antenna assembly as shown in FIGS. 1A and 1B, or with the antenna assembly described above with reference to the earlier filed U.S. patent application Ser. No. 08/729,705, it is difficult to optimize the impedance characteristics of the antenna assembly so as to provide the same impedance value for both the retracted and extended positions of the rod antenna. In this connection, it is noted that the helical antenna is intended to operate as not only a radiator, but also as a kind of matching circuit for the rod antenna in the extended position of the latter, whereas, in the retracted position of the rod antenna, it is intended that the helical antenna operate only as a radiator. By reason of the foregoing, if the rod or monopole antenna is designed to optimize its radiation characteristic in the extended position, it could be difficult to design the helical antenna to achieve the same impedance when the rod or monopole antenna is in its retracted position. Particular difficulty is experienced in achieving optimized impedance characteristics in both the retracted and extended positions of the rod or monopole antenna at values near to 50 ohms, which is likely to be the impedance value of RF circuits, in the absence of an external matching circuit.

OBJECTS AND SUMMARY OF THE INVENTION

Accordingly, it is an object of the present invention to provide an antenna assembly comprising a helical antenna and a rod antenna movable between a retracted position and an extended position relative to the helical antenna, with such helical and rod antennas being arranged so as to optimize the performance of the antenna assembly in both the retracted and extended positions of the rod or monopole antenna.

A further object is to provide an antenna assembly, as above, in which substantially the same impedance value can be achieved for both the extended and retracted positions of the rod or monopole antenna without the necessity of providing any external matching circuit.

In accordance with an aspect of this invention, an antenna assembly for a portable radio apparatus having a housing with a signal line therein comprises a helical antenna extending from the housing and including first and second helical portions which have aligned axes and are electrically separated from each other, a rod antenna extending in the direction of the aligned axes and being movable relative to the helical antenna between a retracted position, in which the rod antenna is removed from within the helical antenna into the interior of the housing, and an extended position, in which the rod antenna extends through the helical antenna to the exterior of the housing, means for establishing an electrical connection between one of the helical portions and the signal line in the housing so that, with the rod antenna in its retracted position, that one helical portion connected with the signal line operates as a radiator, and means for electrically connecting the first and second helical portions with each other only when the rod antenna is in its extended position so that the helical portions then operate jointly as a radiator and also act as a matching section for the rod antenna which is electromagnetically coupled with the signal line through the helical antenna so as to act principally as a radiator.

It is a feature of this invention to select the number of turns of the one helical portion of the helical antenna continuously connected to the signal line so as to provide the antenna assembly with a desired impedance when the rod antenna is in its retracted position, and then to select the length of the rod antenna which extends through the helical antenna in the extended position and the number of turns of the other of the first and second helical portions so as to provide the antenna assembly with the same desired impedance when the rod antenna is in its extended position.

It is a further object of this invention to provide an antenna assembly, as aforesaid, in which the effective length of the monopole antenna may be increased for improving the operating characteristics of the antenna assembly, while reducing the space that is required within the housing of the associated portable radio apparatus for stowing the rod antenna of the movable antenna part when the latter is in its retracted position.

For attaining the last mentioned objective, an antenna assembly according to a feature of this invention further comprises a cylindrical antenna element or an additional helical antenna fixedly located coaxially within the first mentioned helical antenna and electrically isolated therefrom, and cooperating contact means at an end of the rod antenna which extends into the housing of the radio apparatus in the retracted position of the rod antenna and at an end of the cylindrical antenna element or of the additional helical antenna directed away from such housing, respectively, with such cooperating contact means being engageable in the extended position of the rod antenna. Thus, in the case of the cylindrical antenna element, the latter combines with the rod antenna in its extended position to form a monopole antenna having a greater effective length than the rod antenna alone while minimizing the space required within the housing to accommodate such monopole antenna in its retracted position. Similarly, in the case of the additional helical antenna, in the extended position of the rod antenna where the latter is electromagnetically coupled with the first mentioned helical antenna, the cooperating contact means on the rod antenna and on the additional helical antenna, respectively, are engaged so that the additional helical antenna and the rod antenna then form a monopole antenna having a greater effective length than the rod antenna alone so as to again minimize the space required for accommodating the monopole antenna in the retracted position.

The above, and other objects, features and advantages of the invention, will be apparent in the following detailed description of illustrative embodiments thereof when read in connection with the accompanying drawings.

DESCRIPTION OF THE PREFERRED EMBODIMENTS

Figure 2A:
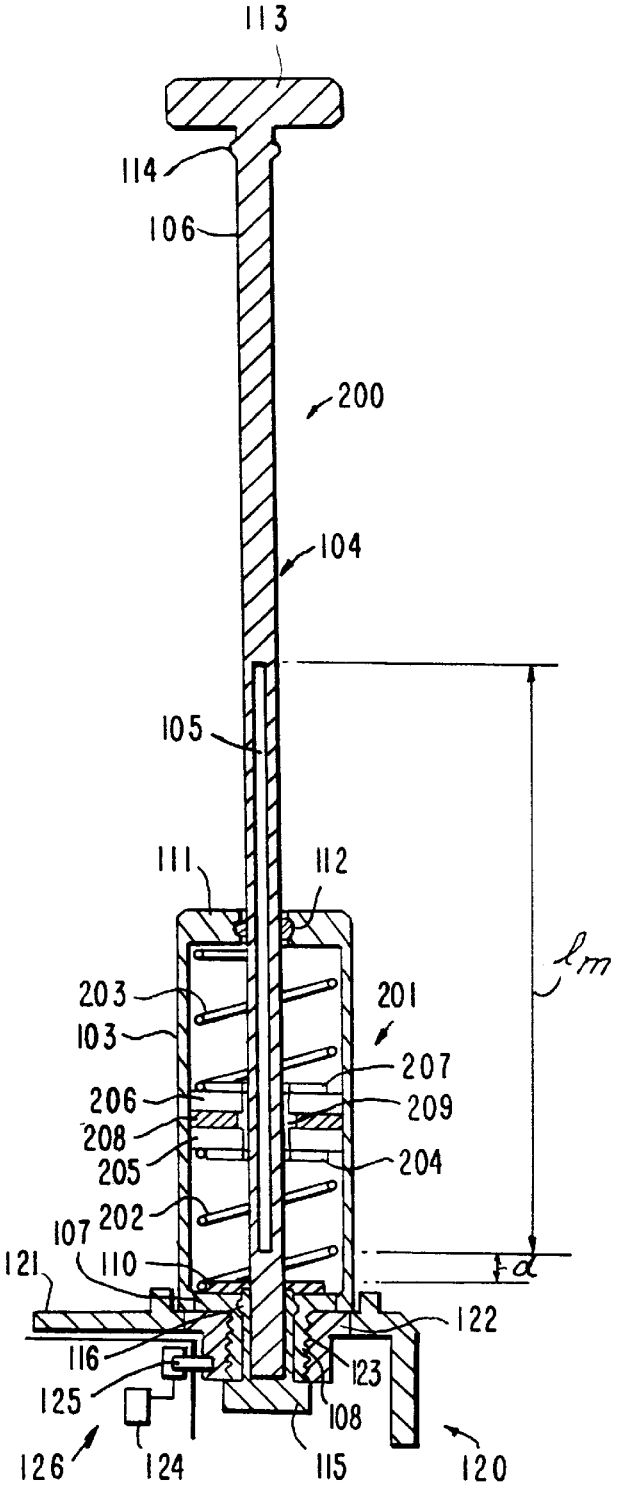
FIGS. 2A and 2B are sectional views of an antenna assembly in accordance with an embodiment of the present invention, and which is shown in an extended position and a retracted position, respectively.
Figure 2B:
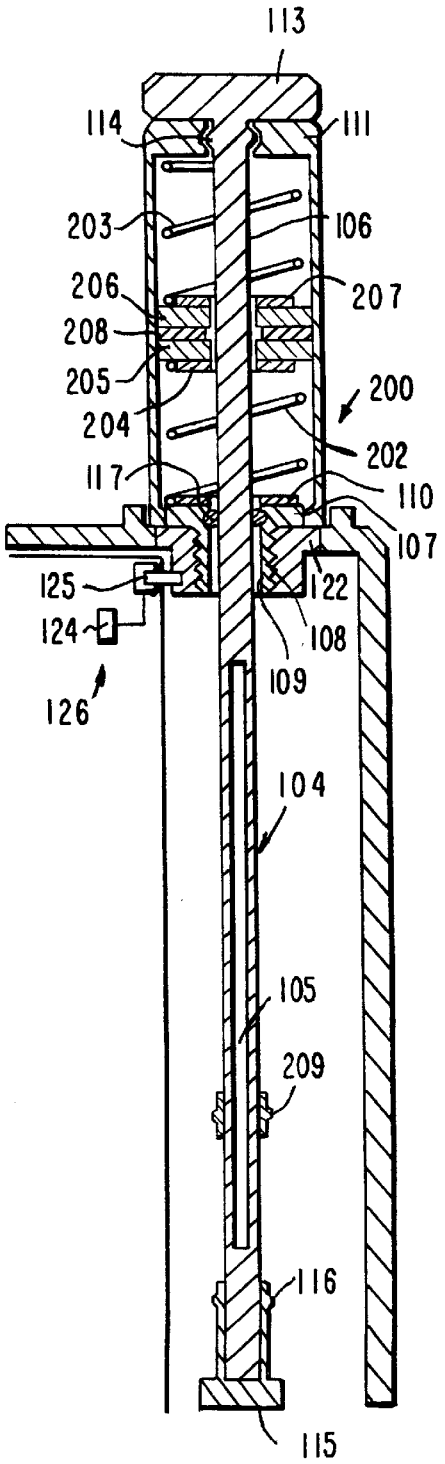

Referring initially to FIGS. 2A and 2B, it will be seen that the antenna assembly 200 according to an embodiment of this invention is there shown to incorporate a number of components which are similar to those previously described in connection with the antenna assembly 100 according to the prior art. For the sake of brevity, such components of the antenna assembly 200 which are similar to components of the antenna assembly 100 will be identified by the same reference numerals, and further detailed description thereof will be omitted.

More particularly, the retractable antenna assembly 200 is shown to generally comprise a movable antenna part 104 constituted by a rod antenna 105 enveloped in a cover 106, and a fixed antenna part 201 constituted by helical antenna portions 202 and 203 housed, in axial alignment with each other, within a cylindrical cover 103.

The fixed antenna part 201 further includes a metal end piece 107 in the form of a disc with an externally threaded hub 108 extending downwardly from the disc 107 about an axial bore 109. An annular metal plate 110 electrically connects the lower end of the helical antenna portion 202 to the disc or end piece 107, and the lower end of the antenna cover 103 is suitably secured on the periphery of disc 107 for positioning the cover 103 in enveloping relation to the axially aligned helical antenna portions 202 and 203. The cover 103 has an upper end wall 111 above the upper end of the helical antenna portion 203 with a central bore 112 extending through end wall 111 in axial alignment with the bore 109 in hub 108. The bores 109 and 112 are again dimensioned so that the movable antenna part 104, that is, the rod antenna 105 and the associated cover 106, can move slidably through bores 109 and 112 between the extended and retracted positions shown on FIGS. 2A and 2B, respectively. For mounting the retractable assembly 200 on a cellular 'phone or other portable radio apparatus 120, the housing 121 of such apparatus is again molded of a suitable plastic with an opening in which a conductive metal mounting member 122 is embedded. Such mounting member 122 has a boss with an internally threaded bore 123 in which the externally threaded hub 108 of the end piece 107 can be threadably engaged. When the antenna assembly 200 is thus mounted on housing 121, the helical antenna portion 202 of the fixed antenna part 201 is continuously powered from a power supply circuit 124 through an antenna clip 125 which establishes an electrical connection between a signal line extending from the power supply circuit 124 and the metal mounting member 122 which is, in turn, electrically contacted with the hub 108 of the disc or end piece 107, and through the annular metal plate 110 in electrical connection with the lower end of the helical antenna portion 202.

However, in accordance with the present invention, the helical antenna portions 202 and 203 are electrically separated from each other except when the movable antenna part 104 is in its extended position shown in FIG. 2A. More particularly, the upper end of the lower helical antenna portion 202 is secured to a metal mounting plate 204 which is, in turn, secured to an annular contact plate 205. The contact plate 205 is spaced from a similar annular contact plate 206 by means of an annular insulating spacer 208, and the lower end of the upper helical antenna portion 203 is secured to the contact plate 206 through a metal mounting plate 207. Thus, the insulating spacer 208 normally serves to electrically separate the helical antenna portions 202 and 203 from each other.

Figure 1A:
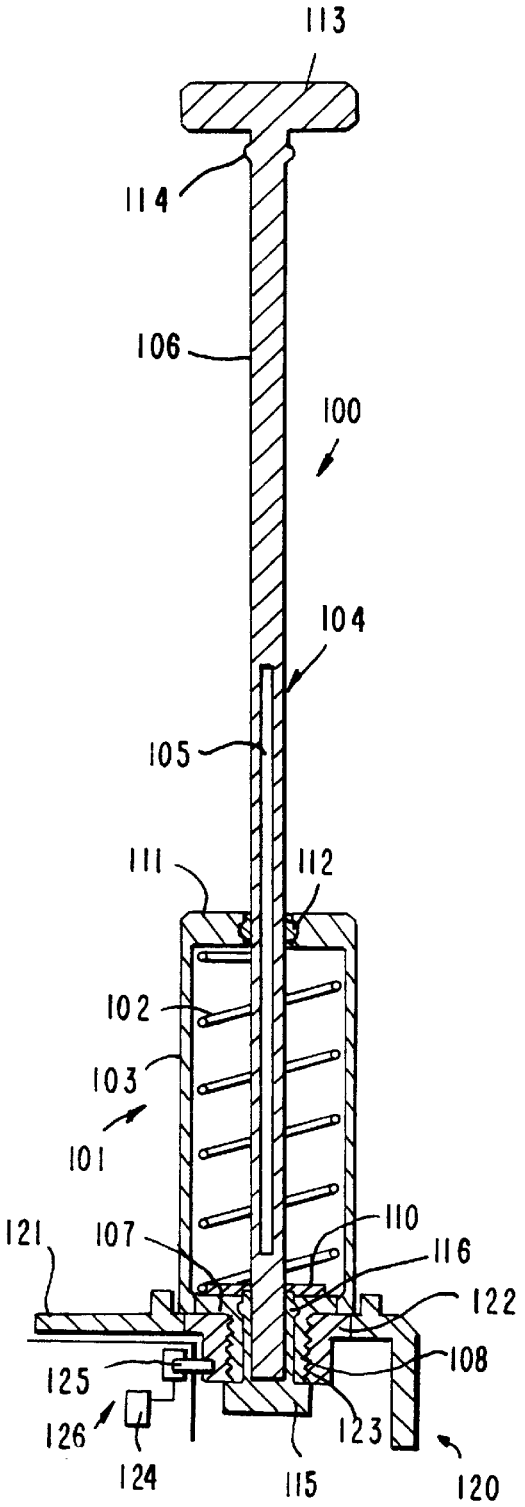
FIG. 1A (PRIOR ART)
FIGS. 1A and 1B are sectional views of an antenna assembly according to the prior art, and which is shown in an extended position and a retracted position, respectively.
Figure 1B:
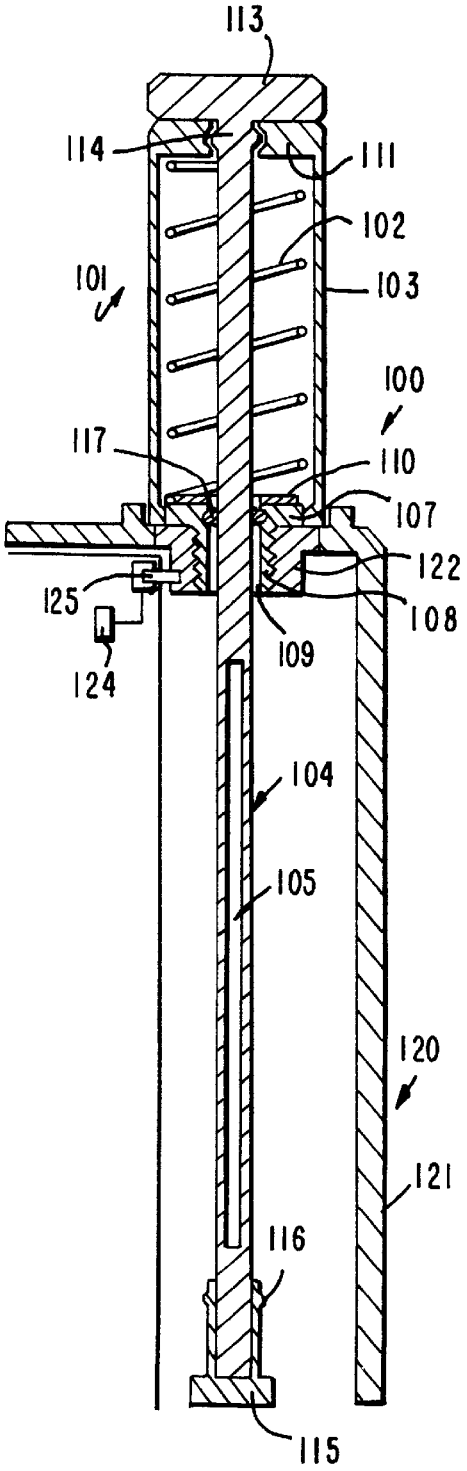
FIG. 1B (PRIOR ART)

The movable antenna part 104 of the antenna assembly 200 may be substantially similar to the like numbered part previously described with reference to FIGS. 1A and 1B and, as such, further includes a knob 113 on the upper end of cover 106 for use in effecting movement of the movable antenna part between its extended and retracted positions, and also to prevent inadvertent downward separation of the movable antenna part 104 from the fixed antenna part 201. An annular protrusion 114 is formed on antenna cover 106 immediately below knob 113 and is dimensioned for snap-in engagement in a similarly shaped indentation or detent formed in the bore 112 extending through end wall 111 of cover 103 so as to releasably retain the movable antenna part in its retracted position, as in FIG. 2B. As before, the stopper 115 at the lower end of the cover 106 is formed with an annular protrusion 116 which, upon movement of the movable antenna part 104 to the extended position shown in FIG. 2A, engages, in a snap-in manner, in a similarly shaped indentation or detent 117 formed in the surface of bore 109, so as to releasably retain the movable antenna part 104 in its extended position. In the embodiment of the present invention illustrated in FIGS. 2A and 2B, the stopper 115 at the lower end of the movable antenna part 104 is of an electrically insulating material, for example, of the same material as the cover 106, so that an electrical connection to or from the rod antenna 105 cannot be established through the stopper 115.

In order to establish an electrical connection between the helical antenna portions 202 and 203 of the antenna assembly 200 embodying this invention when the movable antenna part 104 is in its extended position, an electrically conductive metal annulus 209 extends around and is suitably secured to the cover 106 at a location adjacent the lower end portion of the movable part 104. Such location is selected so that, when the movable antenna part 104 is in its extended position, the conductive annulus 209 simultaneously engages the contact plates 205 and 206 at the upper and lower ends, respectively, of the helical antenna portions 202 and 203.

It will be appreciated from the above that, when the movable antenna part 104 is in its retracted position (FIG. 2B), the metal annulus 209 on cover 106 is axially remote from the contact plates 205 and 206 which are electrically isolated from each other by the insulating spacer 208, with the result that only the lower helical antenna portion 202 is powered from the power supply circuit 124 through antenna clip 125, mounting member 122, disc 107 and plate 110 at the lower end of helical antenna portion 202. In such case, only the lower helical antenna portion 202 operates as the helical antenna with the ground therefor consisting of the shielding case inside the housing of the portable radio apparatus 120 and the ground of the circuit board 126 thereof. Further, in the retracted position of movable antenna part 104, the rod antenna 105 thereof is axially spaced downwardly from the helical antenna portion 202, and also from the mounting member 122, the disc 107 and its hub 108, and the plate 110 at the lower end of the helical antenna portion 202, as shown on FIG. 2B, so as to avoid any electromagnetic coupling between the helical antenna portion 202, which is then operative, and the rod antenna 105. Thus, in the retracted position of the movable antenna part 104, only the lower helical antenna portion 202 of the fixed antenna part 201 is electrically fed and operates as a radiator, while the rod antenna 105 is inoperative and located to avoid interference with the operation of the helical antenna portion 202.

On the other hand, when the movable antenna part 104 is moved to its extended position (FIG. 2A), the electrically conductive metal annulus 209 spans the space between contact plates 205 and 206 and engages the latter for establishing an electrical connection between the upper helical antenna portion 203 and the lower helical antenna portion 202 which, as earlier noted, is continuously connected with the power supply circuit 124. Thus, in the extended position of the movable antenna part 104, the two helical antenna portions 202 and 203 are electrically connected to each other and act as a single helical antenna which operates as a radiator and also as a matching circuit for the rod or monopole antenna 105 which is then electromagnetically coupled with the electrically connected together helical antenna portions 202 and 203.

It has been found that the arrangement of the retractable antenna assembly 200 in accordance with the present invention, as described above, makes it possible to achieve an optimum impedance value of the antenna assembly in both its retracted and extended positions, without the need to resort to an external matching circuit. Thus, the number of turns of the helical antenna portion 202 may be selected to provide the antenna assembly 200 with the desired impedance when the rod antenna 105 is in its retracted position, at which time only the helical antenna portion 202 is operative as a radiator. Furthermore, the length of the rod antenna 105 which extends through the electrically connected together helical antenna portions 202 and 203 in the extended position of the rod antenna 105 and the number of turns of the upper helical antenna portion 203 are selected to provide the antenna assembly with the same desired impedance when the rod antenna 105 is in its extended position, at which time the helical antenna constituted by the connected helical antenna portions 202 and 203 operates as a radiator and also as a matching circuit for the monopole or rod antenna 105 which is fed by electromagnetic coupling from the helical antenna portions 202 and 203.

In a practical example of the retractable antenna assembly 200 in accordance with the embodiment of this invention described above with reference to FIGS. 2A and 2B, substantially the same optimum impedance characteristics are obtained, without the use of an external matching circuit, with the movable antenna part 104 in its retracted and extended positions, respectively, when such retractable antenna assembly has the following parameters:

a) length of rod antenna 105 ($l_m$)=100 mm.

b) distance (d) from the lower end of rod antenna 105, in its extended position, to the lower end of helical antenna portion 202=3 mm.

c) pitch of helical antenna portions 202 and 203=2.2 mm.

d) diameter of helical antenna portions 202 and 203=5.3 mm.

e) number of turns in helical antenna portion 202=2 turns f) number of turns in helical antenna portion 203=3.5 turns.

For both the retracted and extended positions of the movable antenna part 104, the antenna assembly 200 dimensioned as indicated above provides VSWR (voltage standing wave ratio) values of less than 2.0, thereby indicating desirable performance characteristics.

Figure 3A:
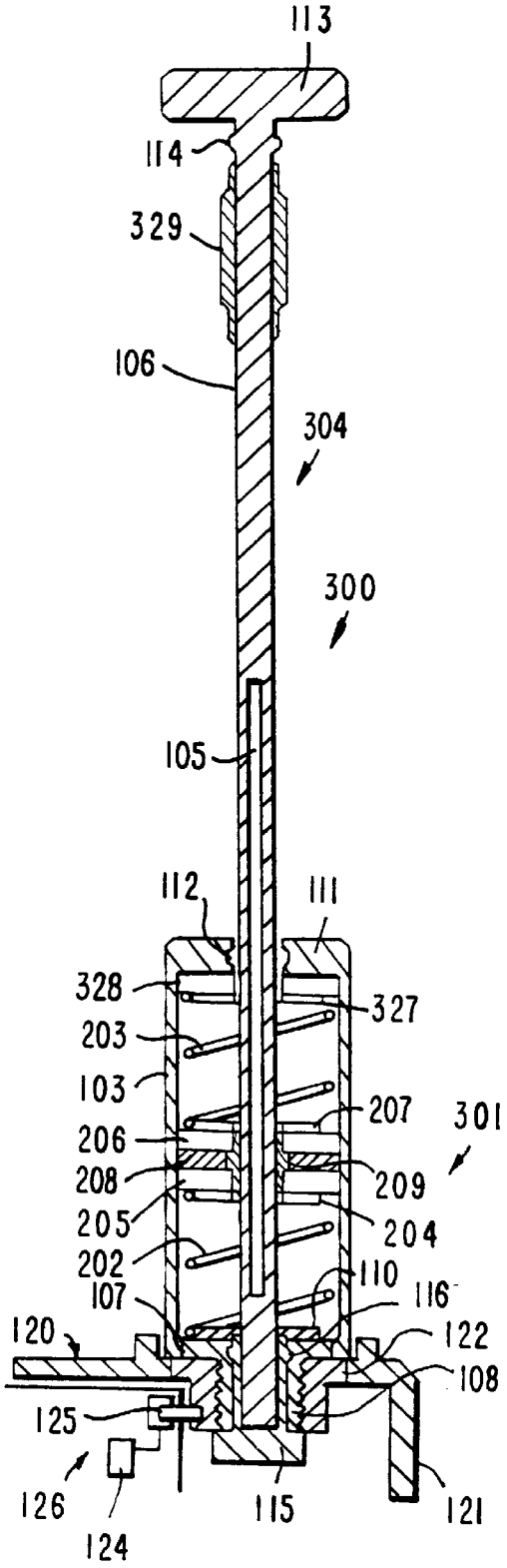
FIGS. 3A and 3B are sectional views similar to FIGS. 2A and 2B, respectively, but showing another embodiment of this invention.
Figure 3B:
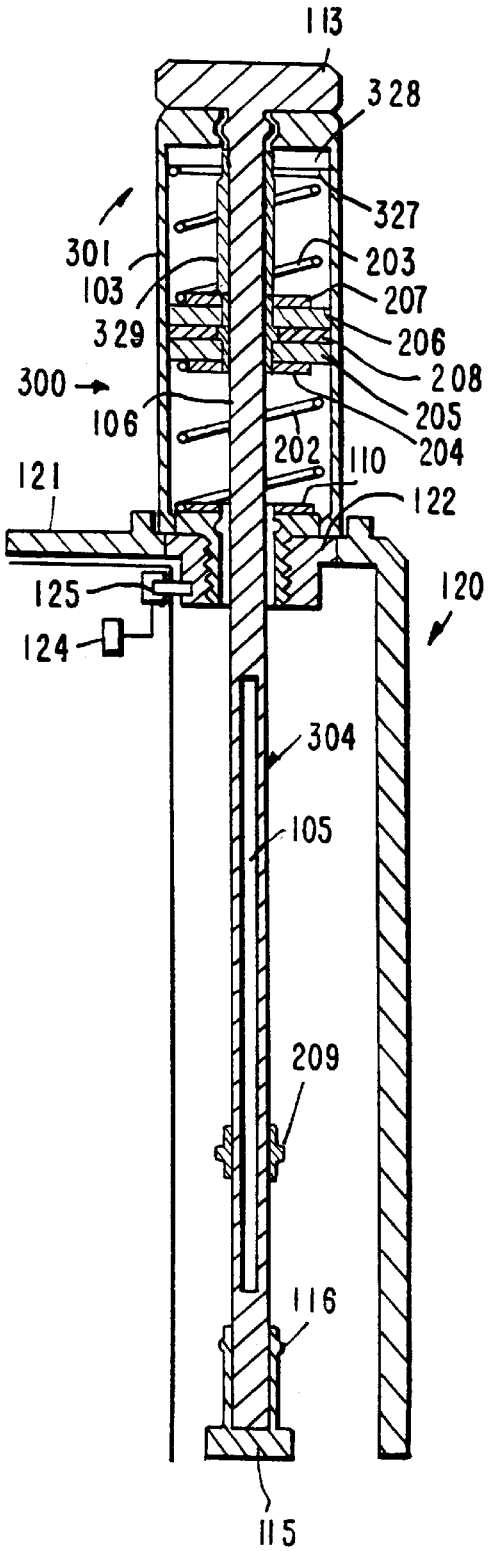

Referring now to FIGS. 3A and 3B, it will be seen that a retractable antenna assembly 300 in accordance with another embodiment of this invention is there shown to be generally similar to the previously described retractable antenna assembly 200, and has its like parts identified by the same reference numerals. Thus, the retractable antenna assembly 300 generally comprises a movable antenna part 304 constituted by a rod antenna 105 enveloped in a cover 106, and a fixed antenna part 301 constituted by helical antenna portions 202 and 203 housed, in axial alignment with each other, within a cylindrical cover 103.

The retractable antenna assembly 300 significantly differs from the retractable antenna assembly 200 only in that the upper helical antenna portion 203, which is not intended to radiate when the movable antenna part 304 is in its retracted position, is then shorted so as to completely suppress operation of the upper helical antenna portion 203 at that time. In order to achieve the foregoing function in the retractable antenna assembly 300, an annuler metal mounting plate 327 is secured to the upper end of the upper helical antenna portion 203 and is electrically connected with an annuler contact plate 328 situated against the upper end 111 of cylindrical housing 103. Further, an elongated annulus 329 of electrically conductive metal is fixed on the upper end portion of the cover 106 of the movable antenna part 304 so as to be disposed well above the cover 103 and thereby avoid any interference with the electrical connection of the helical antenna portion 203 with the helical antenna portion 202 when the movable antenna part 304 is in its extended position (FIG. 3A). However, the elongated metal annulus 329 is dimensioned and positioned so that, when the movable antenna part 304 is in its retracted position (FIG. 3B), the conductive metal annulus 329 is disposed within cover 103 and extends axially through the helical antenna portion 203 for bringing its opposite end portions into electrical contact with the annular contact plates 206 and 328 provided at the lower and upper ends, respectively, of the helical antenna portion 203. Thus, in the retracted position of the movable antenna part 304 in which the electrically conductive metal annulus 209 is removed from engagement with the contact plates 205 and 206 so that the helical antenna portion 203 is then not electrically connected with the powered helical antenna portion 202, the metal annulus 329 on cover 106 further shorts the helical antenna portion 203 for ensuring that any radiation from the helical antenna portion 203 is completely suppressed.

Thus, when the movable antenna part 304 of the antenna assembly 300 is in its retracted position only the helical antenna portion 202 operates as a helical antenna with the ground therefor consisting of the shielding case conventionally provided within the housing 121 of the cellular 'phone or other portable radio apparatus 120 and the ground on the circuit board 126 thereof.

On the other hand, with the movable antenna part 304 of the antenna assembly 300 in its extended position (FIG. 3A), the electrically conductive metal annulus 209 on cover 106 spans the space between contact plates 205 and 206 and electrically contacts the latter for establishing an electrical connection between the upper helical antenna portion 203 and the lower helical antenna portion 202, which, as earlier noted, is continuously connected with the power supply circuit 124. Thus, in the extended position of the movable antenna part 304, the two helical antenna portions 202 and 203 are electrically connected to each other and act as a single helical antenna which operates as a radiator and also as a matching circuit for the rod or monopole antenna 105 which is then electromagnetically coupled with the electrically connected together helical antenna portions 202 and 203.

Figure 4A:
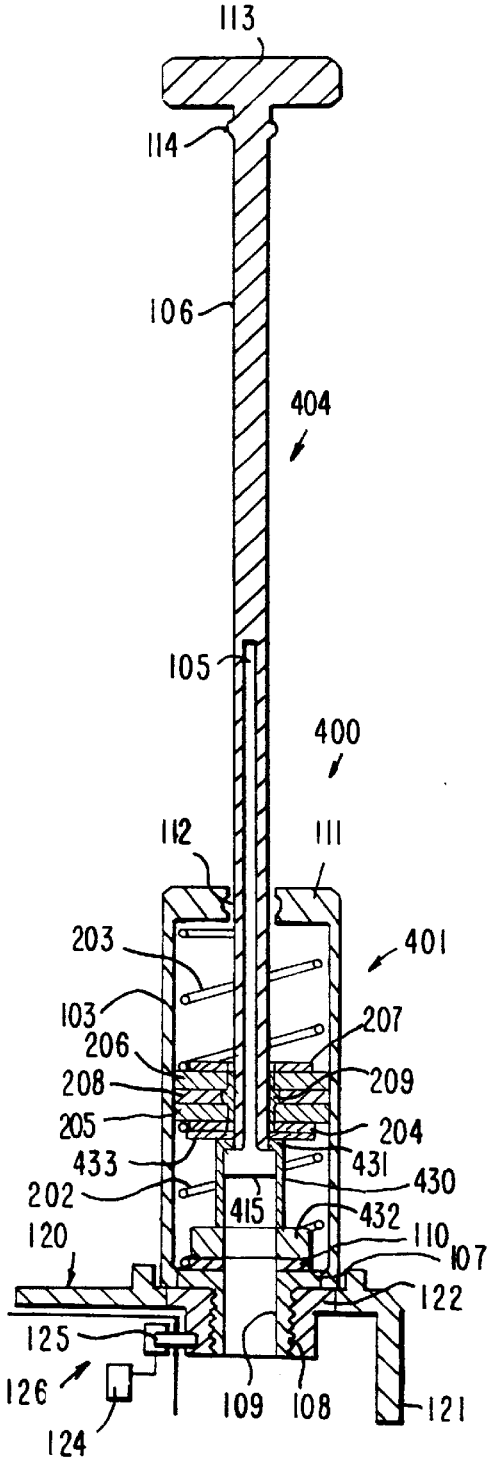
FIGS. 4A and 4B are sectional views similar to FIGS. 2A and 2B, respectively, but showing still another embodiment of the present invention.
Figure 4B:
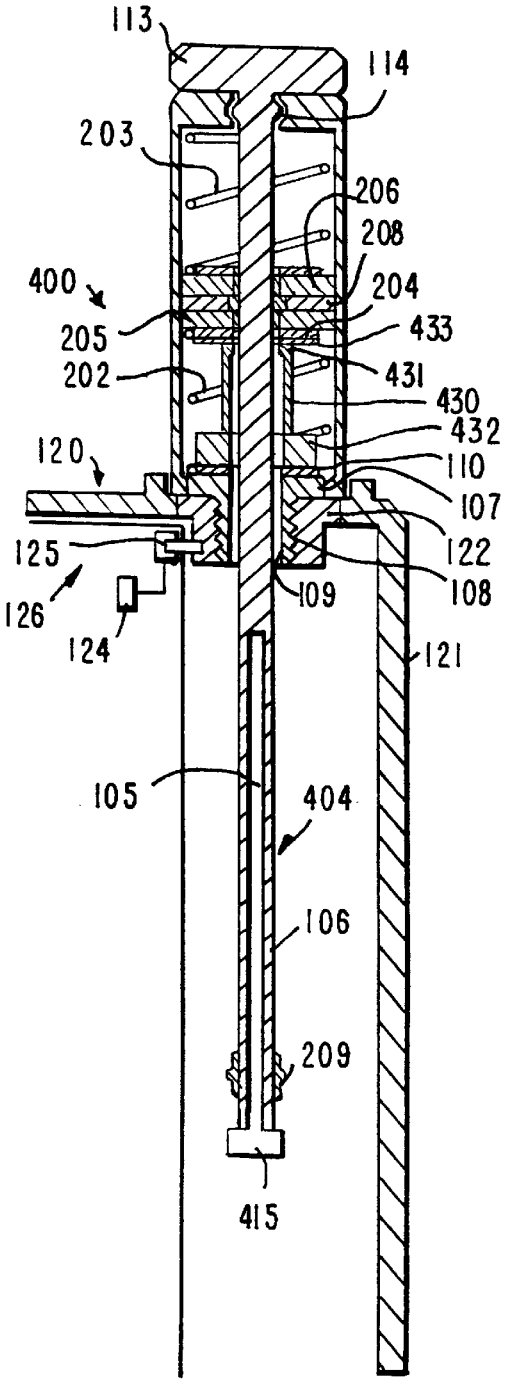

Referring now to FIGS. 4A and 4B, it will be seen that the retractable antenna assembly 400 according to another embodiment of this invention is generally similar to the retractable antenna assembly 200 described above with reference to FIGS. 2A and 2B and has its like parts identified by the same reference numerals. Thus, the retractable antenna assembly 400 is shown to generally comprise a fixed antenna part 401 which includes lower and upper helical antenna portions 202 and 203 in axial alignment with each other within a cylindrical cover 103, and a movable antenna part 404 which includes a rod antenna 105 in a cover 106. The antenna assembly 400 is significantly distinguished from the previously described antenna assembly 200 in that a cylindrical antenna element 430 is fixedly mounted coaxially within the lower helical antenna portion 202, with the rod antenna 105 and its cover 106 being axially movable through the cylindrical antenna element 430 between the extended and retracted positions of FIGS. 4A and 4B, respectively. Further, the stopper 115 of an electrical insulating material provided at the lower end of the movable antenna part 104 in the previously described antenna assembly 200 is replaced, in the retractable antenna assembly 400 of FIGS. 4A and 4B, by a flange 415 of an electrically conductive material at the lower end of the rod antenna 105 which, in this case, projects from the cover 106. Further, the flange 415 is diametrically dimensioned to slide into the cylindrical antenna element 430 when the movable antenna part 404 is moved to its extended position, and the cylindrical antenna element 430 has a centrally apertured upper end wall 431 through which the cover 106 is axially movable. The flange 415 and the end wall 431 are engageable with each other in the extended position of the movable antenna part 404 (FIG. 4A) so as to constitute contacts for electrically connecting the rod antenna 105 with the cylindrical antenna element 430 when the movable antenna part 404 is in its extended position.

For the noted fixed mounting of the cylindrical antenna element 430 within the lower helical antenna portion 202, the antenna assembly 400 has an annular insulating mounting member 432 axially interposed between the lower end of the cylindrical antenna element 430 and the upper surface of the annular metal plate 110 which electrically connects the lower end of helical antenna portion 202 to the disk or end piece 107. Further, an annular insulating mounting member 433 is axially interposed between upper end wall 431 of the cylindrical antenna element 430 and the metal mounting plate 204 which is, in turn, secured to the annular contact plate 205. Thus, the cylindrical antenna member 430 is electrically insulated from the helical antenna portion 202 within which it is fixedly disposed.

It will be appreciated that, when the movable antenna part 404 is in its extended position (FIG. 4A), the cylindrical antenna element 430 fixed within the helical antenna portion 202 is electrically connected, at its upper end, through the flange 415 to the lower end of the rod antenna 105 so that the movable rod antenna 105 and the cylindrical antenna element 430 constitute a monopole antenna having an effective length greater than that of the movable rod antenna 105 alone. By reason of the foregoing, for a monopole antenna of a predetermined length, the length of the movable rod antenna 105 can be relatively reduced, for correspondingly reducing the space required within the housing 121 for accommodating the rod antenna 105 when the movable antenna part 404 is in its retracted position (FIG. 4B). When the movable antenna part 404 is in its retracted position, the metal annulus 209 on cover 106 is axially remote from the contact plates 205 and 206 which are electrically isolated from each other by the insulating spacer 208, with the result that only the lower helical antenna portion 202 is powered from the power supply circuit 124 through antenna clip 125, mounting member 122, disk 107 and plate 110 at the lower end of helical antenna portion 202. Further, the cylindrical antenna element 430, being fixedly disposed within the helical antenna portion 202 can operate as an electromagnetically coupled element. Thus, in the retracted position of the movable antenna part 404, only the lower helical antenna portion 202 operates as a helical antenna electromagnetically coupled with the cylindrical antenna element 430, with the ground therefor consisting of the shielding case inside the housing 121 and the ground of the circuit board 126. In the retracted position of movable antenna part 404, the rod antenna 105 thereof is axially spaced downwardly from the helical antenna portion 202, and also from the mounting member 122, the disk 107 and its hub 108, and the plate 110 at the lower end of the helical antenna portion 202, as shown on FIG. 4B, so as to avoid any electromagnetic coupling between helical antenna portion 202, which is then operative, and the rod antenna 105.

On the other hand, when the movable antenna part 404 is moved to its extended position (FIG. 4A), the electrically conductive metal annulus 209 extends into the space between contact plates 205 and 206 and engages the latter for establishing an electrical connection between the upper helical antenna portion 203 and the lower helical antenna portion 202 which, as earlier noted, is continuously connected with the power supply circuit 124. Furthermore, the conductive metal annulus 209, when engaged between the contact plates 205 and 206, acts to releasably maintain the movable antenna part 404 in its extended position. In such extended position of the movable antenna part 404, the two helical antenna portions 202 and 203 are electrically connected to each other and act as a single helical antenna which operates as a radiator and also as a matching circuit for the monopole antenna constituted by the electrically connected rod antenna 105 and cylindrical antenna element 430 which are then electromagnetically coupled with the electrically connected together helical antenna portions 202 and 203.

Figure 5A:
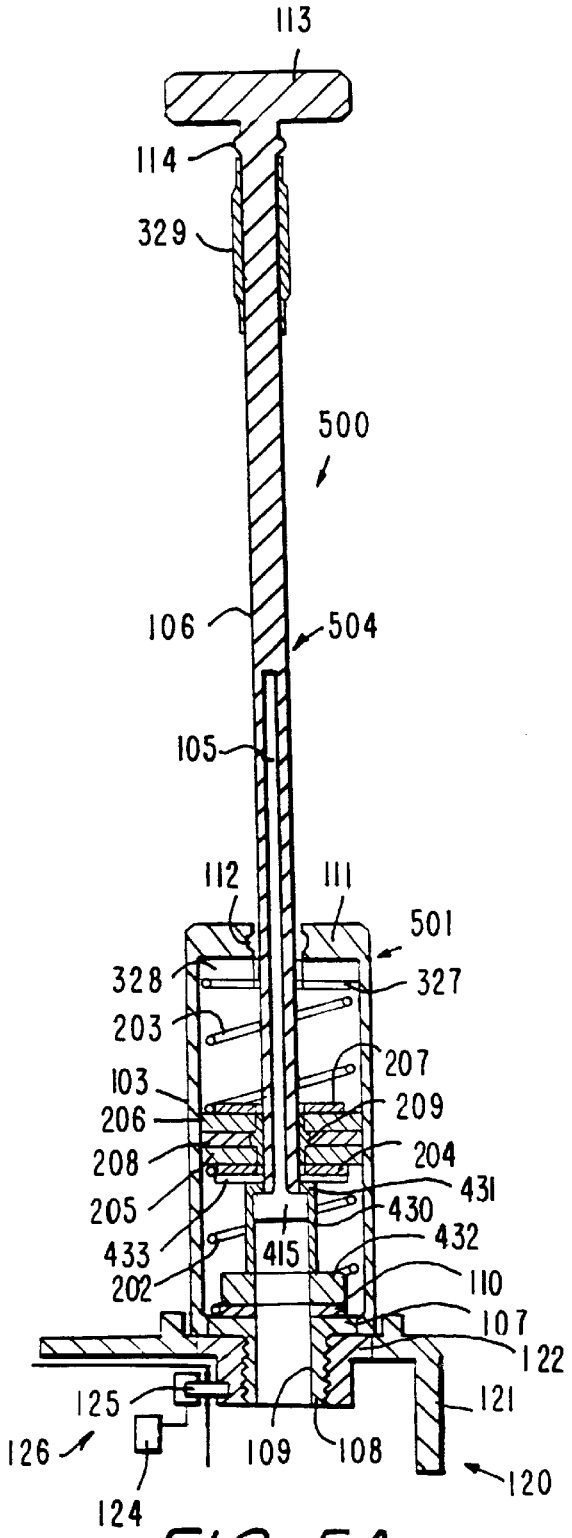
FIGS. 5A and 5B are sectional views similar to FIGS. 2A and 2B, respectively, but showing yet another embodiment of the present invention.
Figure 5B:
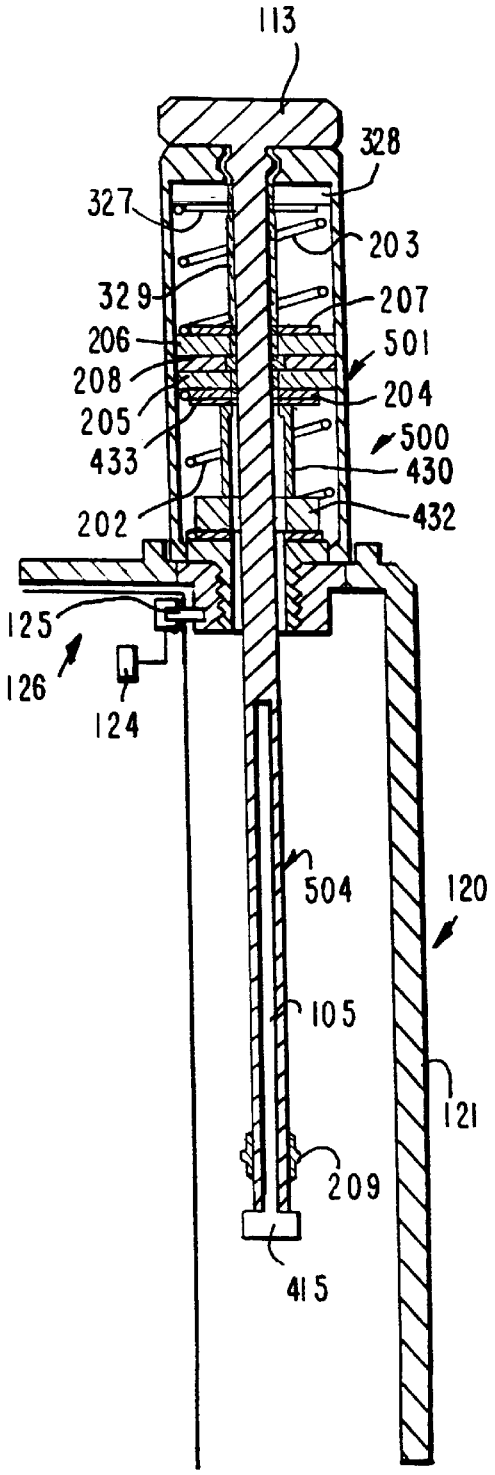

Referring now to FIGS. 5A and 5B, it will be seen that a retractable antenna assembly 500 in accordance with still another embodiment of this invention is there shown to be generally similar to the retractable antenna assembly 400 previously described with reference to FIGS. 4A and 4B, and has its like parts identified by the same reference numerals. Thus, the retractable antenna assembly 500 is shown to generally comprise a fixed antenna part 501 which includes lower and upper helical antenna portions 202 and 203 in axial alignment with each other within a cylindrical cover 103, and a movable antenna part 504 which includes a rod antenna 105 in a cover 106. Further, the antenna assembly 500 includes a cylindrical antenna element 430 fixedly mounted coaxially within the lower helical antenna portion 202, with the rod antenna 105 and its cover 106 being axially movable through the cylindrical antenna element 430 between the extended and retracted positions of FIGS. 5A and 5B, respectively. When the movable antenna part 504 comprised of the rod antenna 105 and cover 106 is in its extended position, the rod antenna 105 is electrically connected with the cylindrical antenna element 430 by the engagement of a metal flange 415 at the lower end of the rod antenna 105 with the centrally apertured upper end wall 431 of the cylindrical antenna element 430 so that the rod antenna 105 and the cylindrical antenna element 430 then constitute a monopole antenna having an effective length substantially greater than the length of the rod antenna 105 alone.

The retractable antenna assembly 500 differs from the previously described antenna assembly 400 only in that it includes the feature of the antenna assembly 300 described with reference to FIGS. 3A and 3B. Thus, as in the retractable antenna assembly 300 of FIGS. 3A and 3B, the antenna assembly 500 shorts the upper helical antenna portion 203, which is not intended to radiate when the movable antenna part 504 is in its retracted position, so as to completely suppress operation of the upper helical antenna portion 203 at that time. In order to achieve the foregoing function in the retractable antenna assembly 500, an annular metal mounting plate 327 is secured to the upper end of the upper helical antenna portion 203 and is electrically connected with an annular contact plate 328 situated against the upper end 111 of cylindrical housing 103. Further, an elongated annulus 329 of electrically conductive metal is fixed on the upper end portion of the cover 106 of the movable antenna part 504 and is operative in precisely the same manner as the annulus 329 in FIGS. 3A and 3B.

It will be appreciated that the retractable antenna assembly 500 of FIGS. 5A and 5B operates in the manner previously described with reference to FIGS. 3A and 3B and FIGS. 4A and 4B and thus enjoys the combined advantages of the antenna assemblies 300 and 400, respectively.

Figure 6A:
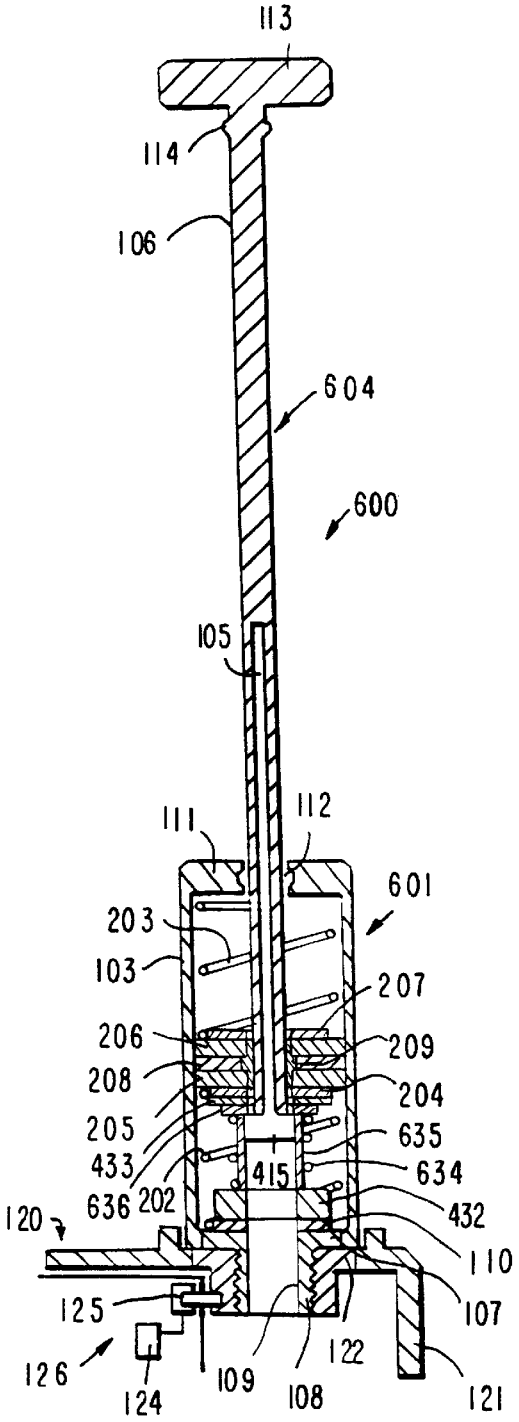
FIGS. 6A and 6B are sectional views similar to FIGS. 2A and 2B, respectively, but illustrating a further embodiment of this invention.
Figure 6B:
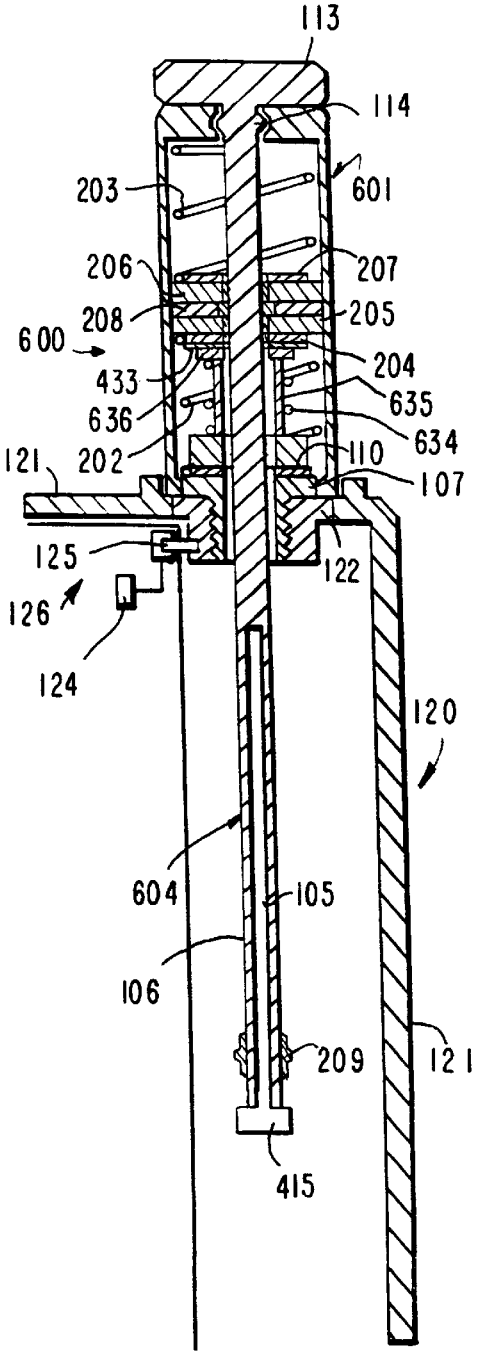

Referring now to FIGS. 6A and 6B, it will be seen that a retractable antenna assembly 600 in accordance with still another embodiment of this invention is there shown to be generally similar to the retractable antenna assembly 400 described above with reference to FIGS. 4A and 4B, and has its like parts identified by the same reference numerals. Thus, the retractable antenna assembly 600 generally comprises a movable antenna part 604 constituted by a rod antenna 105 enveloped in a cover 106 and a fixed antenna part 601 constituted by helical antenna portions 202 and 203 housed, in axial alignment with each other, within a cylindrical cover 103.

The retractable antenna assembly 600 significantly differs from the retractable antenna assembly 400 only in that the cylindrical antenna element 430 fixedly located within the lower helical antenna portion 202 in the fixed antenna part 401 of the antenna assembly 400 is replaced, in the antenna assembly 600, by an additional helical antenna 634 wound about a cylindrical core 635 which is fixed coaxially within the lower helical antenna portion 202. More specifically, a metal contact annulus 636 is suitably secured on the upper end of the core 635 and engages the winding 634, and the metal stopper 415 at the lower end of the rod antenna 105 is axially slidable in the core 635 so as to engage the contact annulus 636 at the top of such core when the movable antenna part 604 is in its extended position (FIG. 6A). Further, the core 635 with the contact annulus 636 at the upper end is seated between annular mounting members 432 and 433 of an insulating material which, in turn, bear against conductive plates 110 and 204 at the bottom and top, respectively, of the lower helical antenna portion 202.

In the retracted position of the movable antenna part 604 (FIG. 6B), the contact plate 205 at the upper end of the lower helical antenna portion 202 is electrically separated, by the insulator 208, from the contact plate 206 at the lower end of the upper helical antenna portion 203. Thus, only the lower helical antenna portion 202 is powered from the power supply circuit 124 through antenna clip 125, mounting member 122, disk 107 and plate 110 at the lower end of helical antenna portion 202. However, since the fixed additional helical antenna 634 on the core 635 is positioned within the helical antenna portion 202 and is electrically insulated therefrom by the members 432 and 433 of insulating material, the additional helical antenna 634 can be electromagnetically coupled with the helical antenna portion 202. In other words, in the retracted position of the rod antenna 105, the helical antenna portion 202 operates as a helical antenna electromagnetically coupled with the additional helical antenna 634, with the ground therefor consisting of the shielding case within the housing 121 of the portable radio apparatus 120 and the ground of the circuit board 126.

When the movable antenna part 604 is moved to its extended position (FIG. 6A), the metal annulus 209 on the cover 106 engages the contact plates 205 and 206 so as to form an electrical connection between the helical antenna portions 202 and 203. Thus, the antenna portions 202 and 203 operate as a single helical antenna. Further, in the extended position of the movable antenna part 604, the flange or stopper 415 at the lower end of the rod antenna 105 engages against the contact plate 636 at the upper end of the core 635 on which the additional helical antenna 634 is wound so as to establish electrical engagement between rod antenna 105 and additional helical antenna 634. At such time, the rod antenna 105 and additional helical antenna 634 operate as a monopole antenna having an effective length substantially greater than the length of the rod antenna 105, and which is fed by electromagnetic coupling with the helical antenna portions 202 and 203. As earlier noted, in the extended position of the movable antenna part 604, the additional helical antenna 634 electromagnetically coupled with the helical antenna portion 202 and the rod antenna 105 electromagnetically coupled with the helical antenna portion 203 and also electrically connected with the additional helical antenna 634 operate essentially as a monopole antenna with the ground therefor consisting of the shielding case within the housing 121 and the ground of the circuit board 126, while the helical antenna portions 202 and 203 operate not only as a radiator but also as a matching circuit for the rod antenna 105.

It will be appreciated that the retractable antenna assembly 600 has advantages similar to those described with reference to the antenna assembly 400, particularly in respect to its ability to increase the effective length of the monopole antenna when the movable antenna part 604 is in its extended position, while minimizing the space required within the housing 121 for stowing the rod antenna 105 when the movable antenna part 604 is in its retracted position.

Figure 7A:
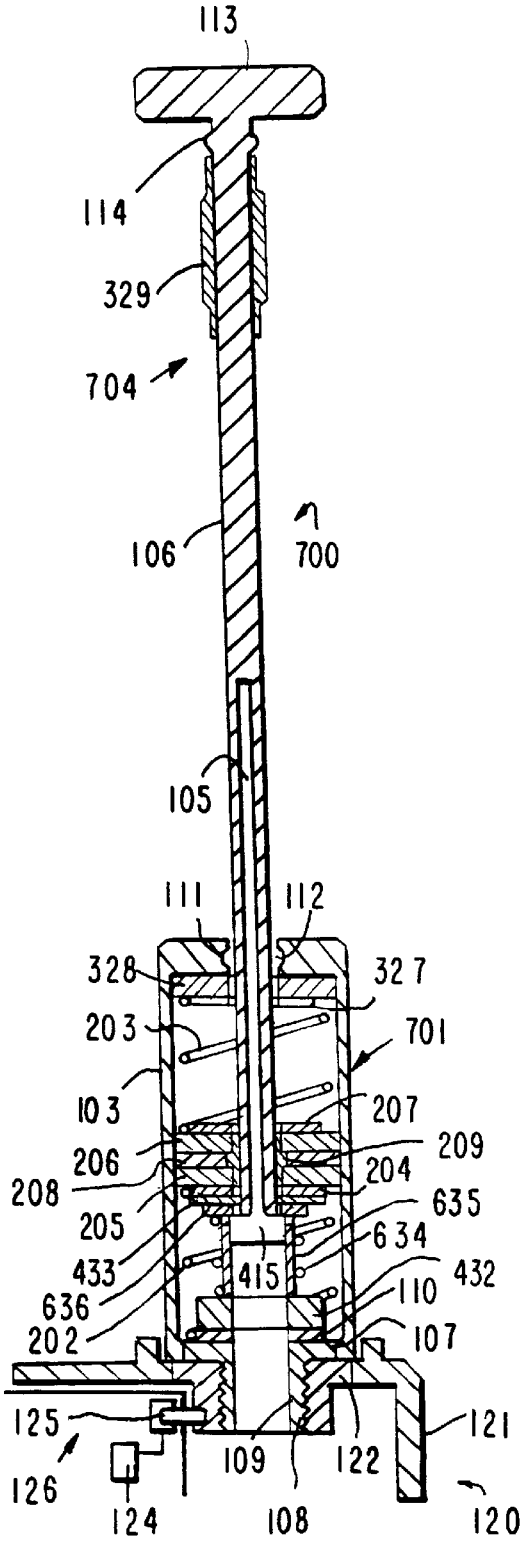
FIGS. 7A and 7B are sectional views similar to FIGS. 2A and 2B, respectively, but illustrating yet another embodiment of this invention.
Figure 7B:
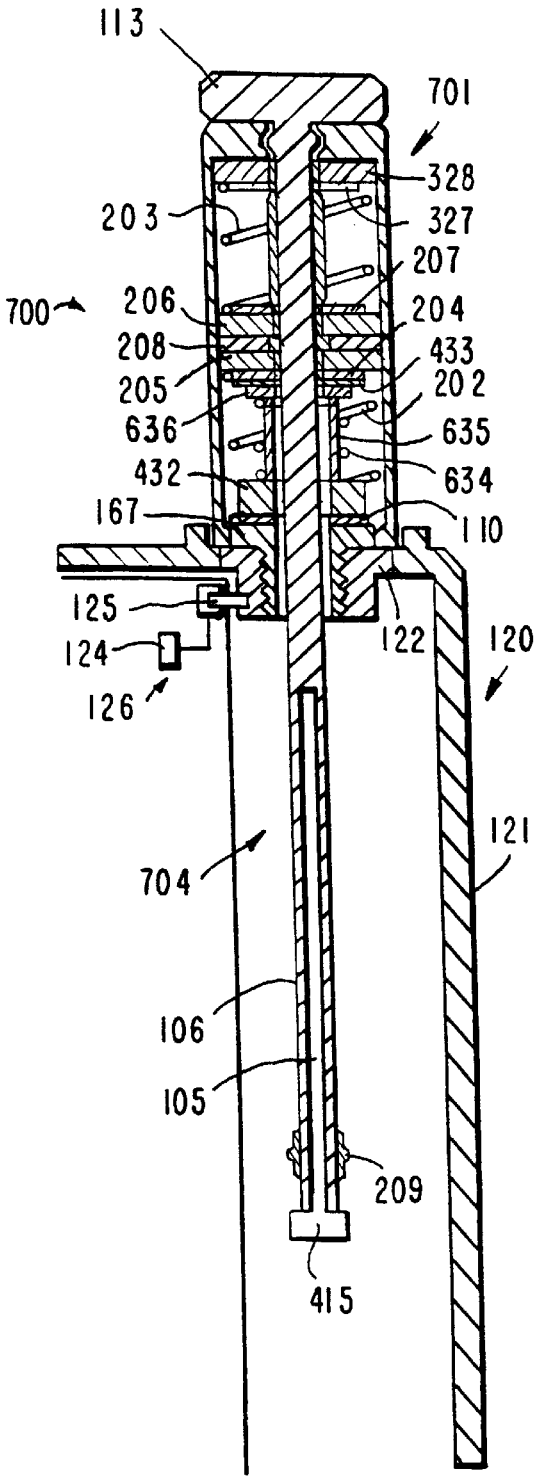

Referring now to FIGS. 7A and 7B, it will be seen that a retractable antenna assembly 700 according to yet another embodiment of this invention is there shown to be generally similar to the retractable antenna assembly 600 described above with reference to FIGS. 6A and 6B and has like parts identified by the same reference numerals. Thus, the retractable antenna assembly 700 generally comprises a movable antenna part 704 including a rod antenna 105 within a cover 106 and a fixed antenna part 701 including lower and upper helical antenna portions 202 and 203 coaxially housed within a cover 103, and an additional helical antenna 634 on a core 635 which is fixedly located within the helical antenna portion 202 so that, in the extended position of the movable antenna part 704 (FIG. 7A), a flange 415 at the lower end of the rod antenna 105 engages a contact plate 636 on the core 635 for electrically connecting the additional helical antenna 634 with the rod antenna 105, while the metal annulus 209 on the cover 106 electrically connects the helical antenna portions 202 and 203 to each other. As before, only the lower helical antenna portion 202 is electrically connected to the power supply circuit 124 so that, when the movable antenna part 704 is moved to its retracted position (FIG. 7B) and, in response thereto, the metal annulus 209 no longer engages contact plates 205 and 206, the upper helical antenna portion 203 is electrically separated from the lower helical antenna portion 202 by the insulator 208. However, in order to ensure that radiation from the helical antenna portion 203 will be completely suppressed in the retracted position of the movable antenna part 704, the antenna assembly 700, similarly to the antenna assembly 500, is provided with an elongated metal annulus 329 fixed on the cover 106 and positioned to engage the contact plates 206 and 328 at the lower and upper ends of the helical antenna portion 203 for shorting the latter when antenna part 704 is in the retracted position.

It will be appreciated that the retractable antenna assembly 700 enjoys the functional advantages that have been described above in connection with the antenna assemblies 500 and 600 of FIGS. 5A and 5B and of FIGS. 6A and 6B, respectively.

It will be seen that, in all of the described embodiments of the invention, an antenna assembly for a cellular phone or other portable radio apparatus having a housing with a signal line therein comprises a helical antenna extending from the housing and including first and second helical portions 202 and 203 which have aligned axes and are electrically separated from each other, a rod antenna 105 extending in the direction of the aligned axes and being movable relative to the helical antenna between a retracted position, in which the rod antenna 105 is removed from within the helical antenna into the interior of the housing 121, and an extended position, in which the rod antenna extends through the helical antenna to the exterior of the housing. Further, in all embodiments, an electrical connection is established between one of the helical antenna portions and the signal line in the housing so that, with the rod antenna 105 in its retracted position, that one helical antenna portion 102 connected with the signal line operates as a radiator, and the first and second helical antenna portions 202 and 203 are electrically connected with each other only when the rod antenna is in its extended position so that the helical antenna portions then operate jointly as a radiator and also act as a matching circuit for the rod antenna 105 which is electromagnetically coupled with the signal line through the helical antenna so as to act principally as a radiator. By reason of the foregoing, it is possible in all embodiments of the invention to select the number of turns of the one helical antenna portion 202 continuously connected to the signal line so as to provide the antenna assembly with a desired impedance when the rod antenna 105 is in its retracted position, and then to select the length of the rod antenna which extends through the helical antenna in the extended position and the number of turns of the other of the first and second helical antenna portions 203 so as to provide the antenna assembly with the same desired impedance when the rod antenna is in its extended position.

Further, in the embodiments described with reference to FIGS. 4A and 4B, 5A and 5B, 6A and 6B, and 7A and 7B, respectively, it is possible to increase the effective length of the monopole antenna for improving the operating characteristics of the antenna assembly, without correspondingly increasing the space that is required within the housing of the associated portable radio apparatus for stowing the rod antenna of the movable antenna part when the latter is in its retracted position. Such further advantage results from the cylindrical antenna element 430 or the additional helical antenna 634 fixedly located coaxially within the helical antenna portion 202 and electrically isolated therefrom, and the flange 415 at the lower end of the rod antenna 105 and engageable with the end wall 431 of the cylindrical antenna element 430, or with the contact plate 636 of the additional helical antenna 634 in the extended position of the rod antenna. Thus, in the case of the cylindrical antenna element, the latter combines with the rod antenna in its extended position to form a monopole antenna having a greater effective length than the rod antenna alone while minimizing the space required within the housing to accommodate such monopole antenna in its retracted position. Similarly, in the case of the additional helical antenna, in the extended position of the rod antenna where the latter is electromagnetically coupled with the first mentioned helical antenna, the additional helical antenna and the rod antenna then form a monopole antenna having a greater effective length than the rod antenna alone so as to again minimize the space required for accommodating the monopole antenna in the retracted position.

Although a number of specific embodiments of the invention have been described in detail herein with reference to the drawings, it is to be understood that the present invention is not limited to those precise embodiments, and that various changes and modifications may be effected therein by one skilled in the art without departing from the scope or spirit of the present invention as defined in the appended claims.

What is claimed is:

1. An antenna assembly for a portable radio apparatus having a housing with a signal line therein, said antenna assembly comprising:

a helical antenna extending from said housing and including a first helical portion and a second helical portion which have aligned axes and are electrically separated from each other;

a rod antenna extending in the direction of said axes and being movable relative to said helical antenna between a retracted position, in which said rod antenna is removed from within said helical antenna into the interior of said housing, and an extended position, in which said rod antenna extends through said helical antenna to the exterior of said housing;

means for establishing an electrical connection between one of said first and second helical portions and said signal line within the housing so that, with said rod antenna in said retracted position, said one helical portion connected with the signal line operates as a radiator; and means for electrically connecting said first and second helical portions with each other when said rod antenna is in said extended position so that said first and second helical portions then operate jointly as a radiator and also as a matching circuit for said rod antenna which is electromagnetically coupled with said signal line through said helical antenna so as to act principally as a radiator.

2. The antenna assembly according to claim 1, wherein the number of turns of said one helical portion of the helical antenna is selected to provide the antenna assembly with a desired impedance when said rod antenna is in said retracted position, and wherein the length of said rod antenna which extends through said helical antenna in said extended position and the number of turns of the other of said first and second helical portions are selected to also provide the antenna assembly with said desired impedance when said rod antenna is in said extended position.

3. The antenna assembly according to claim 1, wherein said means for electrically connecting said first and second helical portions of the helical antenna is movable with said rod antenna in the axial direction thereof.

4. The antenna assembly according to claim 3, further comprising a first antenna cover enveloping and moving with said rod antenna and extending axially beyond an end portion of said rod antenna which projects from said helical antenna in said extended position of the rod antenna, and a second antenna cover fixed around said helical antenna for enveloping the latter and having an opening at one end through which projects said first antenna cover extending axially beyond said end portion of the rod antenna.

5. The antenna assembly according to claim 4, wherein said means for electrically connecting said first and second helical portions of the helical antenna is a metal piece attached to said first antenna cover.

6. The antenna assembly according to claim 4, further comprising means for shorting the other of said first and second helical portions when said rod antenna is in said retracted position.

7. The antenna assembly according to claim 6, wherein said means for shorting includes an electrically conductive member on said first antenna cover which electrically contacts both ends of said other helical portion when said rod antenna is in said retracted position.

8. The antenna assembly according to claim 1, further comprising means for shorting the other of said first and second helical portions when said rod antenna is in said retracted position.

9. The antenna assembly according to claim 1, further comprising a cylindrical antenna element fixedly mounted coaxially within said helical antenna and through which said rod antenna is axially movable between said extended and retracted positions while being electrically isolated from said cylindrical antenna element, and cooperating contact means at an end of said rod antenna which extends into said housing in said retracted position and at an end of said cylindrical antenna element directed away from said housing, respectively, and which are electrically engageable with each other in said extended position of the rod antenna so that said cylindrical antenna element and said rod antenna then form a monopole antenna having a greater effective length than said rod antenna alone while minimizing the space required within said housing to accommodate said monopole antenna in said retracted position.

10. The antenna assembly according to claim 9, in which said cooperating contact means include a conductive flange at said end of the rod antenna which extends into said housing and an end wall at said end of the cylindrical antenna element having a central opening through which said rod antenna movably extends, with said flange engaging said end wall at said extended position of the rod antenna.

11. The antenna assembly according to claim 9, further comprising means for shorting the other of said first and second helical portions when said rod antenna is in said retracted position.

12. The antenna assembly according to claim 9, wherein the number of turns of said one helical portion of the helical antenna is selected to provide the antenna assembly with a desired impedance with said rod antenna in said retracted position, and wherein the lengths of said rod antenna and said cylindrical antenna which extend through said helical antenna in said extended position and the number of turns of the other said first and second helical portions are selected to also provide the antenna assembly with said desired impedance in said extended position of the rod antenna.

13. The antenna assembly according to claim 9, further comprising a first antenna cover enveloping and moving with said rod antenna and extending axially beyond an end portion of said rod antenna which projects from said helical antenna in said extended position of the rod antenna, and a second antenna cover fixed around said helical antenna for enveloping the latter and having an opening at one end through which projects said first antenna cover extending axially beyond said end portion of the rod antenna.

14. The antenna assembly according to claim 13, in which said cooperating contact means include a conductive flange projecting beyond said first cover at said end of the rod antenna which extends into said housing in said retracted position, and an end wall at said end of the cylindrical antenna element having a central opening through which said first cover normally extends for engaging said flange with said end wall when said rod antenna is in said extended position.

15. The antenna assembly according to claim 14, wherein said means for electrically connecting said first and second helical portions of the helical antenna includes a first metal annulus extending around said first cover and movable with the latter for simultaneously engaging adjacent ends of said first and second helical portions when said rod antenna is in said extended position, and further comprising a second metal annulus fixed on said first cover for movement with the latter and being situated to simultaneously engage opposite ends of the other of said first and second helical positions, and thereby short said other helical portion of the helical antenna, when said rod antenna is in said retracted position.

16. The antenna assembly according to claim 1, further comprising an additional helical antenna fixedly located coaxially within the first mentioned helical antenna and electrically insulated from the latter, said additional helical antenna being diametrically dimensioned to permit movement of said rod antenna therethrough between said retracted and extended positions, and cooperating contact means at an end of said rod antenna which extends into said housing in said retracted position and at an end of said additional helical antenna directed away from said housing, respectively, and which are electrically engageable with each other in said extended position of the rod antenna so that said additional helical antenna and said rod antenna then form a monopole antenna having a greater effective length than said rod antenna alone while minimizing the space required within said housing for accommodating said monopole antenna in said retracted position.

17. An antenna assembly according to claim 16, wherein said additional helical antenna is wound on a cylindrical core having a conductive end wall at said end of the additional helical antenna directed away from said housing, said end wall having a central opening through which said rod antenna movably extends, and wherein said cooperating contact means includes a conductive flange at said end of the rod antenna dimensioned to move into said cylindrical core and into engagement with said conductive end wall of the core upon said movement of the rod antenna to said extended position.

18. The antenna assembly according to claim 16, further comprising means for shorting the other of said first and second helical portions when said rod antenna is in said retracted position.

19. The antenna assembly according to claim 16, wherein the number of turns of said one helical portion of the helical antenna is selected to provide the antenna assembly with a desired impedance when said rod antenna is in said retracted position, and wherein the lengths of said rod antenna and of said additional helical antenna which extend through said helical antenna in said extended position of the rod antenna and the number of turns of the other of said first and second helical portions are selected to also provide the antenna assembly with said desired impedance when said rod antenna is in said extended position.

20. The antenna assembly according to claim 16, further comprising a first antenna cover enveloping and moving with said rod antenna and extending axially beyond an end portion of said rod antenna which projects from said helical antenna in said extended position of the rod antenna, and a second antenna cover fixed around said helical antenna for enveloping the latter and having an opening at one end through which projects said first antenna cover extending axially beyond said end portion of the rod antenna.

21. The antenna assembly according to claim 20, in which said cooperating contact means include a conductive flange projecting beyond said first cover at said end of the rod antenna which extends into said housing in said retracted position, and a conductive end wall at said end of a cylindrical core supporting said additional helical antenna within said first helical antenna, said end wall having a central opening through which said first cover is movable for engaging said flange with said end wall when said rod antenna is in said extended position.

22. The antenna assembly according to claim 21, wherein said means for electrically connecting said first and second helical portions of the first helical antenna includes a first metal annulus extending around said first cover and movable with the latter for simultaneously engaging adjacent ends of said first and second helical portions when said rod antenna is in said extended position, and further comprising a second metal annulus fixed on said first cover for movement with the latter and being situated to simultaneously engage opposite ends of the other of said first and second helical portions, and thereby short said other helical portion of the helical antenna, when said rod antenna is in said retracted position.

* * * * *